US005097546A

United States Patent [19]

Turner, III

[11] Patent Number: 5,097,546

[45] Date of Patent: Mar. 24, 1992

[54] BIAXIAL ROCKING SWINGING HAMMOCK FRAME

[76] Inventor: George C. Turner, III, 76 Jackson St. #7, Hoboken, N.J. 07030

[21] Appl. No.: 711,882

[22] Filed: Jun. 7, 1991

[51] Int. Cl.[5] ..... A45F 3/22

[52] U.S. Cl. ..... 5/127; 5/120; 5/122; 248/165

[58] Field of Search ..... 5/120, 122, 127, 129; 248/165, 166; 297/441

[56] References Cited

U.S. PATENT DOCUMENTS

| | | | |
|---|---|---|---|
| 180,729 | 8/1876 | Richardson et al. . | |
| 315,354 | 4/1885 | Ten Eyck . | |
| 441,507 | 11/1890 | Sale . | |
| 1,032,211 | 7/1912 | Hibbs . | |
| 2,551,865 | 5/1951 | Benjamin | 5/129 |
| 3,783,458 | 1/1974 | Westrich | 5/129 |
| 3,901,551 | 8/1975 | Wiesner | 297/441 X |
| 4,585,270 | 4/1986 | Singer | 248/165 X |
| 4,691,394 | 8/1987 | Woo . | |
| 4,901,381 | 2/1990 | Sergold . | |
| 4,951,332 | 6/1990 | Barmettler . | |

FOREIGN PATENT DOCUMENTS 1406 of 1884 United Kingdom ..... 5/129

OTHER PUBLICATIONS

Advertisement for "Sling Rocker" Chair from Pueblo to People catalogue of Dec. 1990.

*Primary Examiner*—Michael F. Trettel

*Attorney, Agent, or Firm*—Palmatier & Sjoquist

[57] ABSTRACT

A biaxial rocking swinging hammock frame is comprised of two bipods for supporting a hammock with two connecting rope-like ends. The first bipod has an apex adapted for securing one connecting end of the hammock thereto and a foot upon which the bipod pivots along a first bipod pivot axis. The second bipod has an apex opposing the apex of the first bipod. The second bipod apex is adapted for securing the other connecting end of the hammock to suspend the hammock. The second bipod has a foot upon which the second bipod pivots along a second bipod pivot axis. Link means connect the feet for locating and holding the foot and pivot axis of the first bipod below the second bipod and the foot and pivot axis of the second bipod below the first bipod.

8 Claims, 6 Drawing Sheets

BIAXIAL ROCKING SWINGING HAMMOCK FRAME

BACKGROUND OF THE INVENTION

This invention relates generally to hammocks. More particularly, the invention relates to a biaxial rocking swinging hammock frame.

Hammocks are well known as a furniture-like device for providing support for an individual to recline, relax or sleep. Hammocks are typically made of fabric material and are elongate or rectangular in shape. The material is gathered along their short sides and secured by some means such as a rope which may extend beyond the hammock for securing and suspending the hammock from supports such as a tree, a frame or hooks on a building. Some hammocks also have spreaders which are sticks transversely oriented with respect to the elongation of the hammock to expose more of a horizontal surface of the hammock to aid in entering and leaving the hammock. Hammocks may be made of flexible fabric or a netting material. Often awnings or screen structures are added above the hammocks for comfort of the individual with respect to protection against the elements and insects.

U.S. Pat. No. 180,729 discloses such a described hammock supported by secured struts and bars by way of guys. This hammock stand quite clearly requires a flat support surface or ground area.

U.S. Pat. Nos. 315,354 and 4,901,381 disclose hammocks supported by lead ropes secured to stakes in the ground and supported above the ground by tent poles. This arrangement requires that the ground can be suitably penetrated by the sticks and pointed legs or poles.

U.S. Pat. No. 1,032,211 discloses a triangulated hammock frame comprised of struts and side members secured together by wires and bolts to rigidify the frame. This frame also requires a substantially flat ground surface and appears to be quite tippy.

U.S. Pat. No. 441,507 also discloses a hammock with a complex pivotally connected frame along with guys, which appears to be quite complex, and contacts the ground at eight different points again requiring that ground be substantially flat.

U.S. Pat. No. 4,691,394 discloses a collapsible hammock frame of light-weight support members that are rigidly tied together by tensile strength wire to prevent the inward movement of the weight support members.

U.S. Pat. No. 4,951,332 shows a hammock and frame essentially made from a cradle-type structure above the hammock. This arrangement obviously hampers the individual hammock user from entering and leaving the hammock.

There is a need for a hammock frame that is easy to store, transport, set up, disassemble and without a need to anchor to the ground. The hammock frame should be supportable by any ground surface of various shapes, uniformities and densities. The hammock frame should be stable, strong and of a simple and inexpensive construction while using minimal materials. While most hammocks swing back and forth transverse to the elongation of the hammock, it would be desirous for a hammock to have a unique additional motion such as rocking along the length of the hammock.

SUMMARY OF THE INVENTION

A biaxial rocking swinging hammock frame is comprised of two bipods for supporting a hammock with two connecting rope like ends. The first bipod has an apex adapted for securing one connecting end of the hammock thereto and a foot upon which the bipod pivots along a first bipod pivot axis. The second bipod has an apex opposing the apex of the first bipod. The second bipod apex is adapted for securing the other connecting end of the hammock to suspend the hammock. The second bipod has a foot upon which the second bipod pivots along a second bipod pivot axis. Link means connect the feet for locating and holding the foot and pivot axis of the first bipod below the second bipod and the foot and pivot axis of the second bipod below the first bipod.

A principal object and advantage of the present invention is its simplicity in design with ease of access into and out of the hammock frame while providing a unique range of motion that allows the individual or occupant to both swing the hammock as well as to rock the hammock back and forth in the direction along the length of the hammock much like a rocking chair. The rocking motion is perpendicular to the swinging motion allowing the vast range of motion by the occupant within the hammock.

Another object and advantage is that the hammock frame is inexpensive with a minimal amount of material that is easy to store, transport, set up, disassemble and which does not require anchoring to either a vertical support or to the ground.

Another object and advantage of the present invention is that the hammock frame may be used on a variety of terrains or foundations that otherwise would provide difficulties for other hammock designs normally intended for flat, firm or uniform surfaces.

Another object and advantage of the present invention is that the hammock has an adjustable center of gravity wherein the load is shared equally by all its legs making the hammock frame a stronger and longer lasting unit.

Yet another object and advantage of the present invention is that it is simple to use in that the occupant may readily occupy and leave the hammock, free of any hammock frame obstructions.

BRIEF DESCRIPTION OF THE DRAWINGS

FIG. 2 is a left side elevational view of the hammock frame of the present invention;

FIG. 3 is a right side elevational view of the present invention;

DETAILED SPECIFICATION

Figure 1:
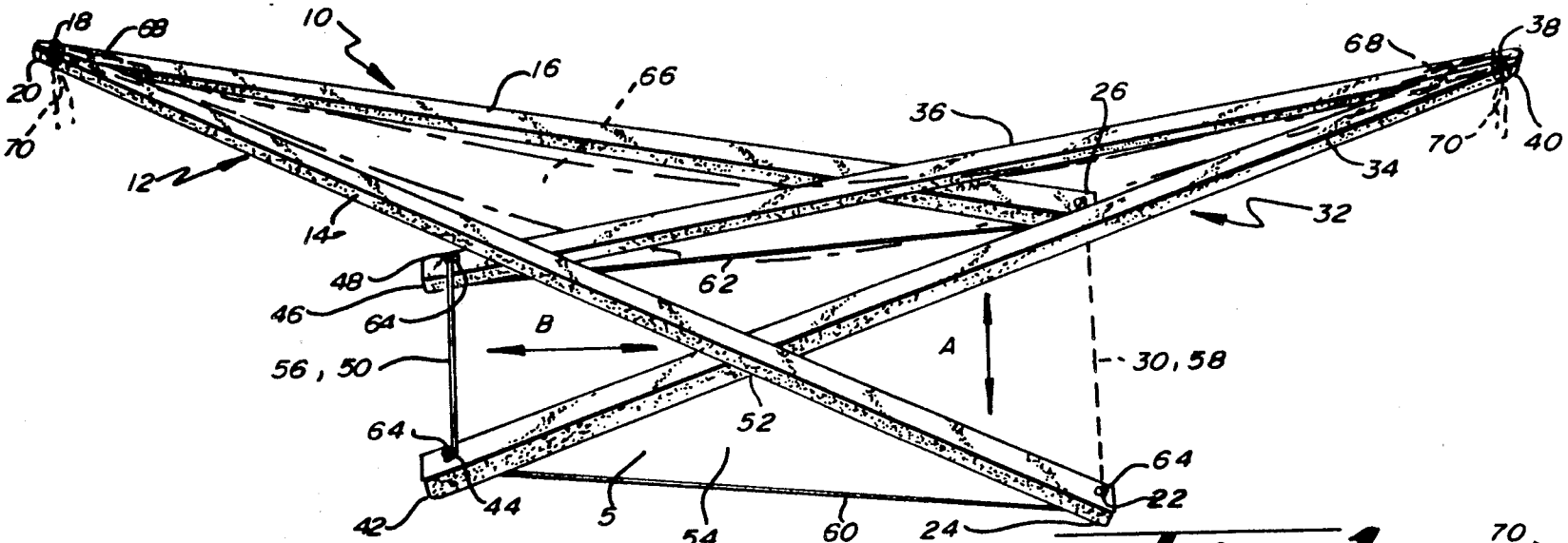
FIG. 1 is a perspective view of the hammock frame of the present invention with the hammock shown in broken outline.
Figure 4:
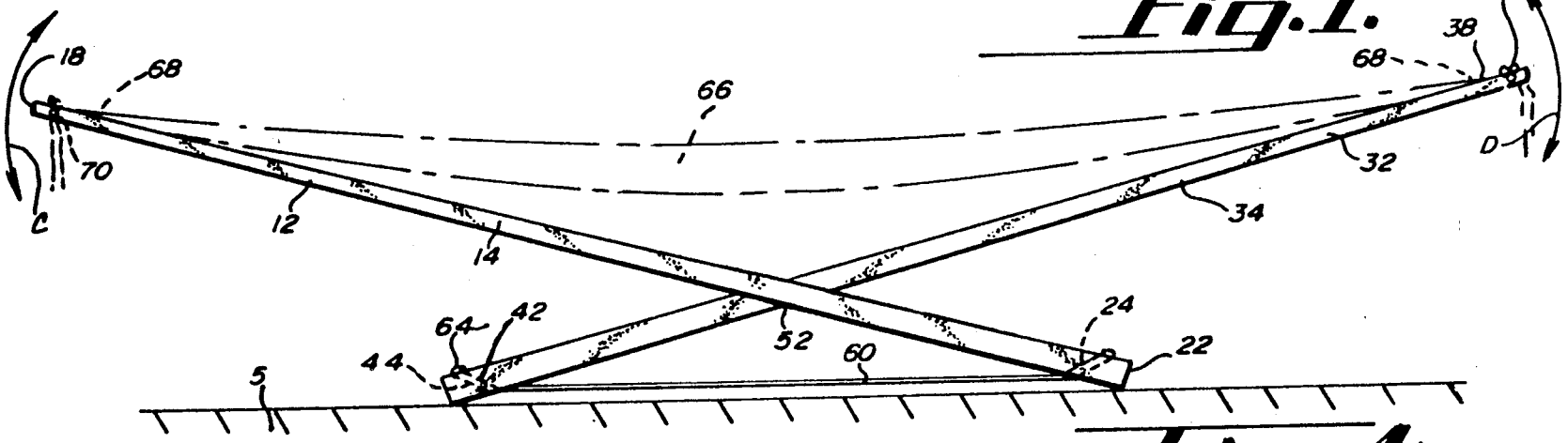
FIG. 4 is a front elevational view of the present hammock frame upon the ground.
Figure 6:
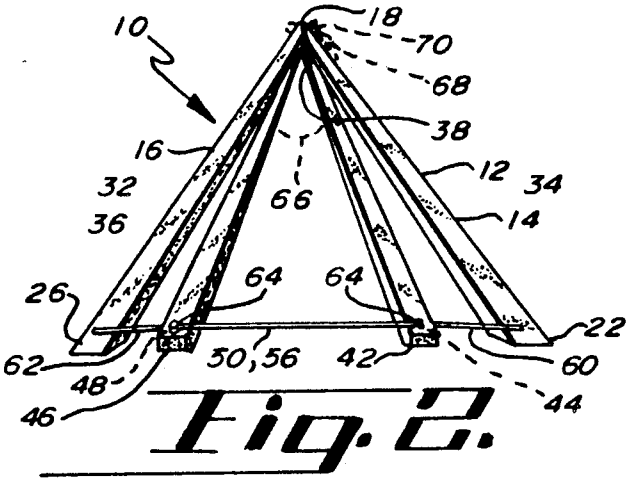
FIG. 6 is a bottom view of the present hammock frame.
Figure 7:
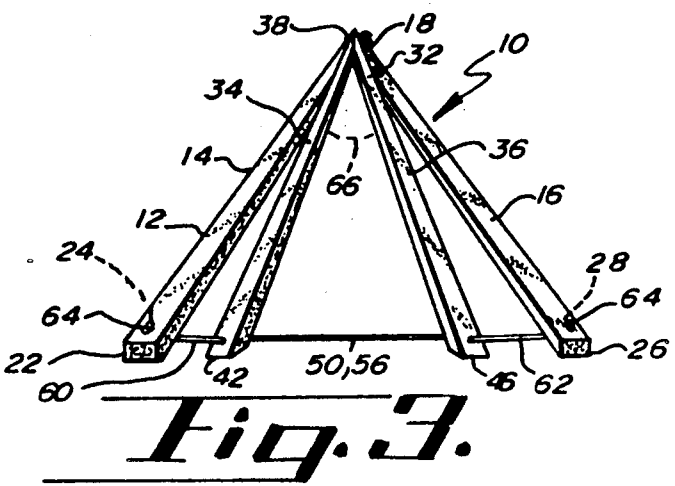
FIG. 7 is a perspective view of a modified hammock frame of the present invention.
Figure 5:
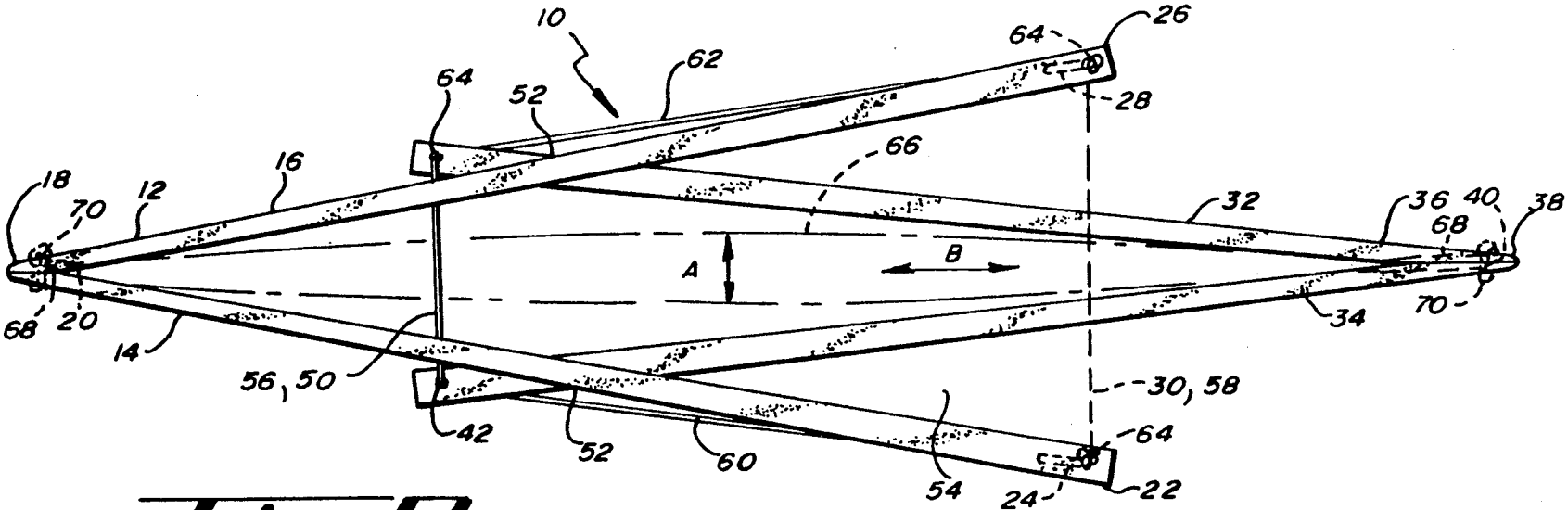
FIG. 5 is a top plan view of the present invention.
Figure 6:
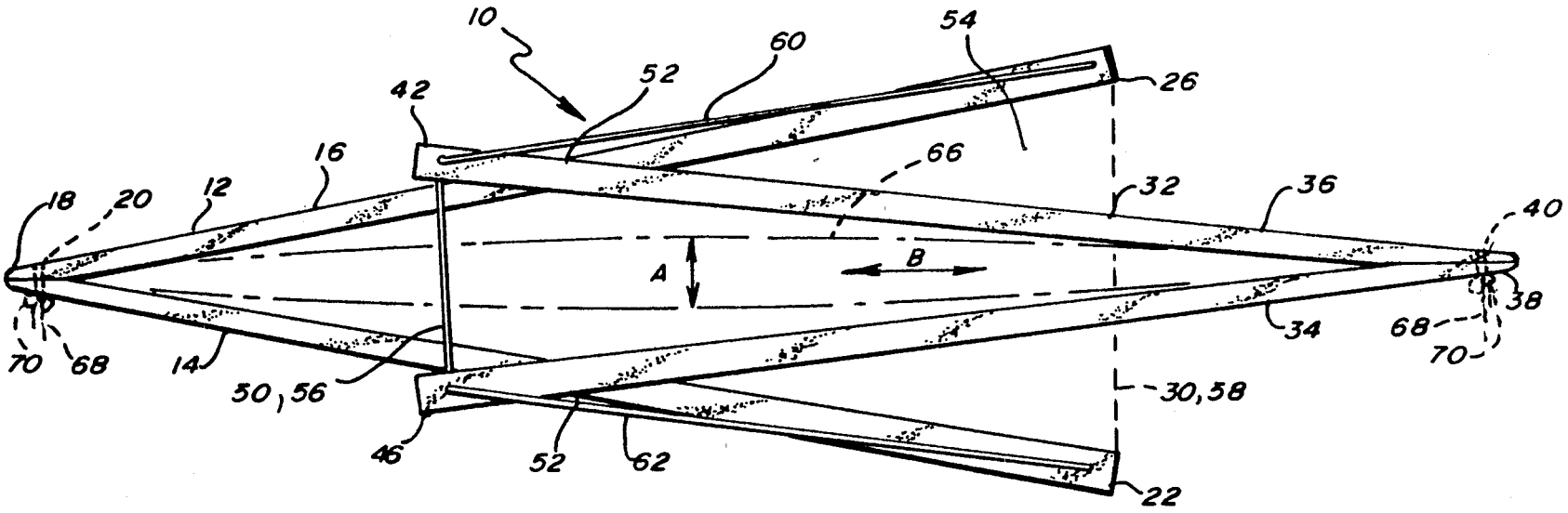
Figure 7:
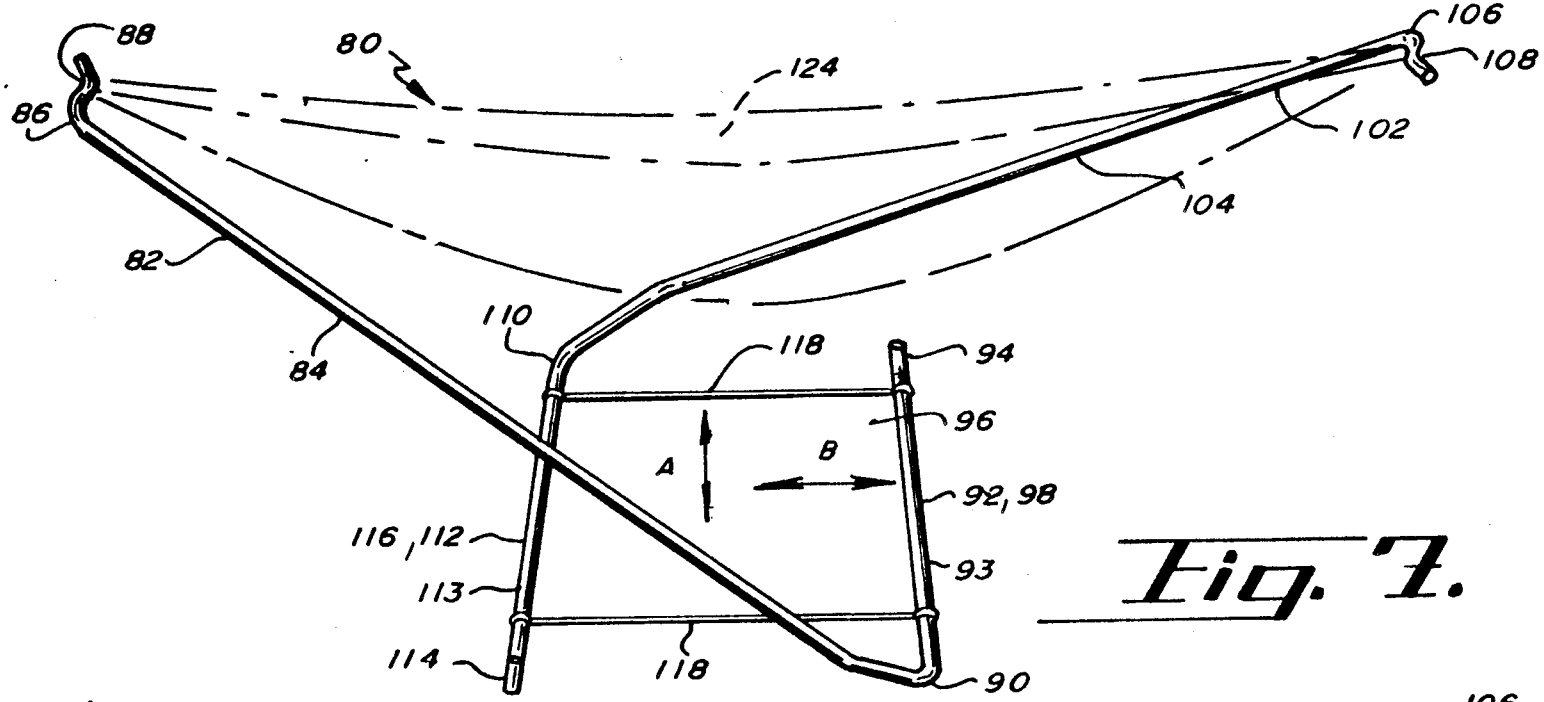
Figure 9:
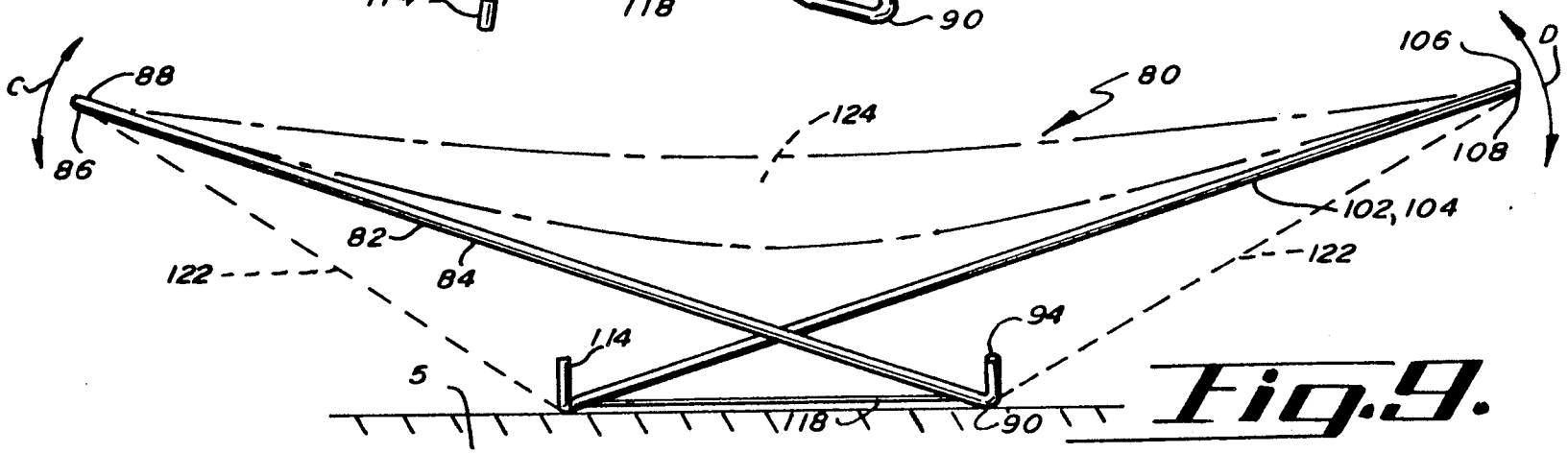
FIG. 9 is a front elevational view of the modified hammock frame.
Figure 10:
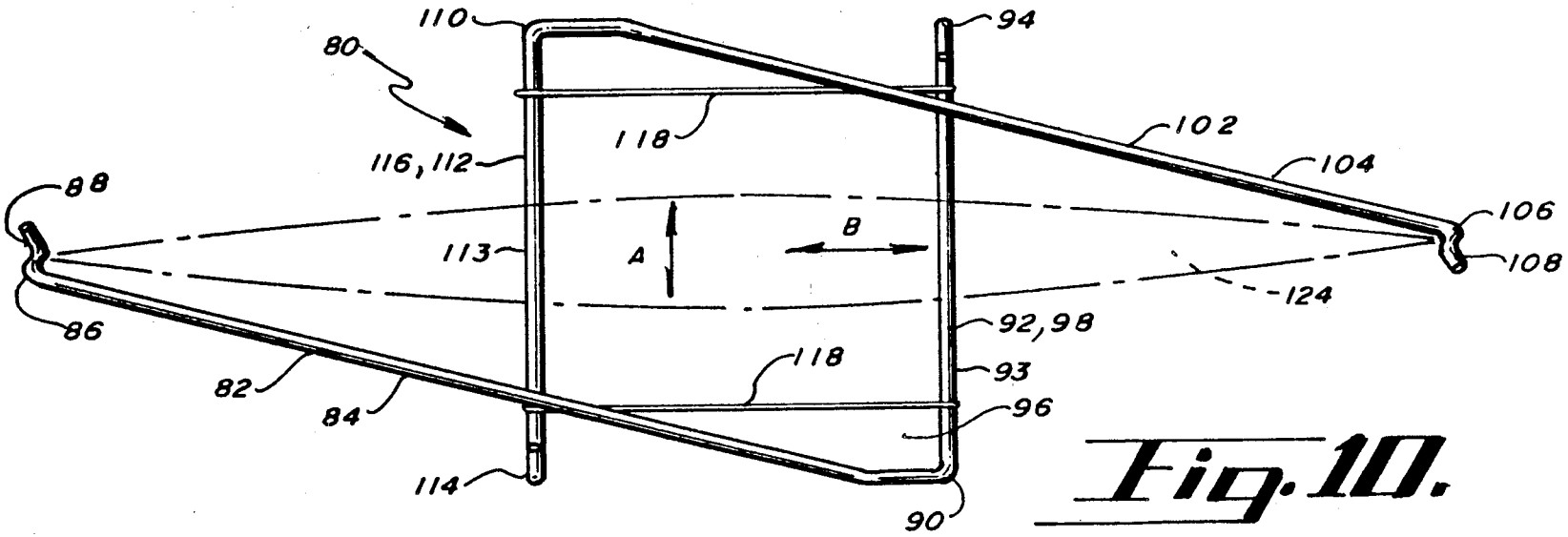
FIG. 10 is a top plan view of the modified hammock frame.
Figure 8:
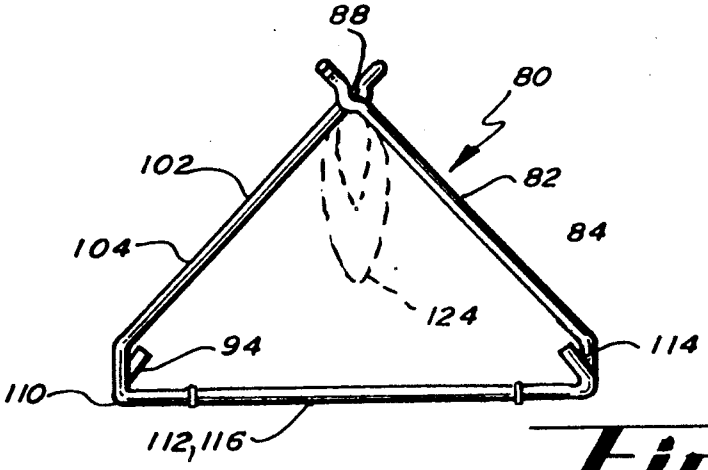
FIG. 8 is either a left or right side elevational view of the hammock frame of FIG. 7.
Figure 11:
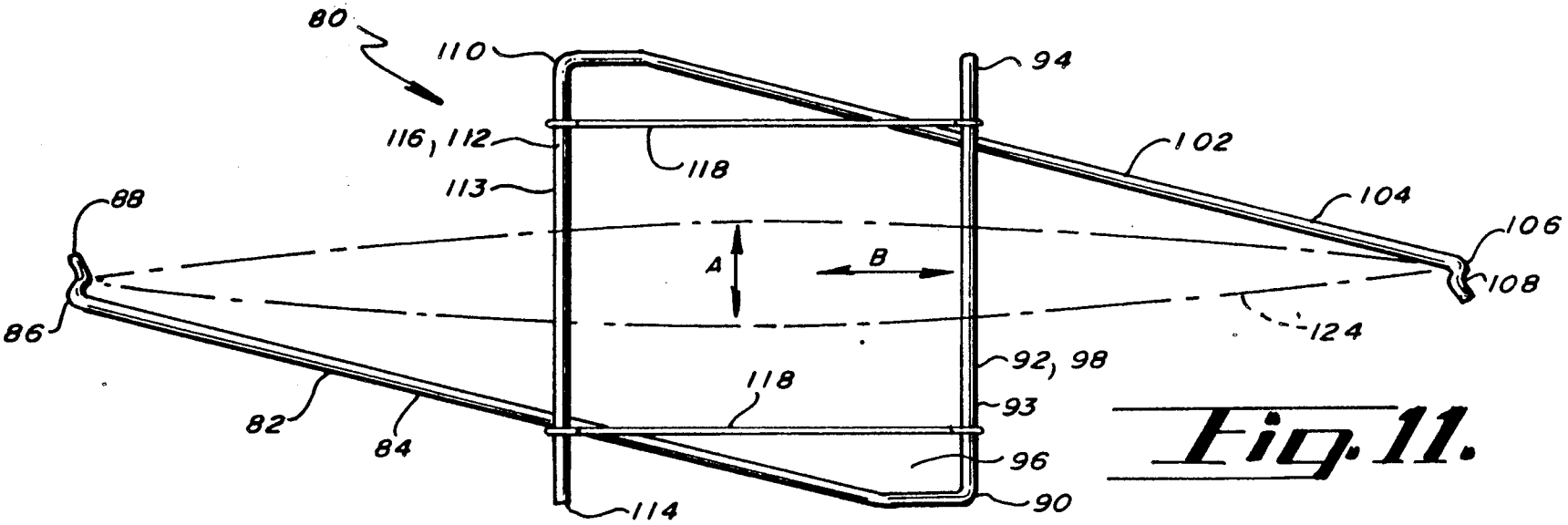
FIG. 11 is a bottom view of the modified hammock frame.

Referring to FIGS. 1–6, the biaxial rocking swinging hammock frame 10, as supported on the ground 5, may generally be seen. Hammock frame 10 generally includes a first bipod 12 having an apex 18 and a first bipod pivot axis 30. A second bipod 32 similarly has an apex 38 and a second bipod pivot axis 50. The bipods 12 and 32 are isosceles triangular in shape or planar formation and intersect with respect to each other at point 52 which is approximately just below the center of gravity of hammock frame 10 which supports hammock 66 and its would-be occupant.

More specifically, biaxial rocking swinging hammock frame 10 has a first bipod 12 which forms an isosceles triangular plane with the bipod 12's first leg or pole 14 and second leg or pole 16 forming the two longer equal distant legs of an imaginary isosceles triangle. The upper leg ends are joined together to form the apex 18. Upper portions of legs 14 and 16 may be beveled as to fit closely together, may be hinged, or simply may be held adjacent each other to form apex 18 by means of a rope passing through apex aperture 20 which constitutes the fastening point for hammock 66 further described hereinafter. The first leg 14 has the first foot 22 through which an aperture 24 is located while the second leg or pole 16 also has a second foot 26 with a similar aperture 28 therethrough. Where feet 22 and 26 contact the ground 5, a first bipod pivot axis 30 is located upon which the first bipod 12 pivots or rotates in an upward and downward fashion (see arrow C) as will be appreciated later.

Similar to the first bipod 12 is the second bipod 32. Second bipod 32 includes its first leg or pole 34 and its second leg or pole 36 which suitably are joined together at their upper portions or ends to form apex 38. Apex aperture 40 suitably passes through apex 38 to form a suitable fastening point for hammock 66. The first leg 34 has a first foot 42 at its lower end and also aperture 44 suitably passes therethrough. Second leg 36 also has a second foot 46 of bipod 32 through which aperture 48 passes through as again will be appreciated later. Where second bipod 32's first and second feet 42 and 46 contact the ground 5, second bipod pivot axis 50 is found. Pivot axis 50 is generally shorter from foot 42 to foot 46 compared to the distance between feet 22 and 26 of the first bipod 12 which forms its pivot axis 30. It will be appreciated that the second bipod is similar in the shape to that of an imaginary isosceles triangle and forms a similar plane as the first bipod 12. Where the imaginary triangular planes of the first bipod 12 and the second bipod 32 intersect at point 52, the approximate center of gravity may be located just thereabove. It will be noted that as the second bipod rotates about pivot axis 50 (arrow D and the first bipod 12 pivots about its pivot axis 30 (arrow C), the bipod intersection point 52 moves longitudinally (arrow B). This occurs when the hammock frame 10 is rocked or apexes 18 and 30 are moved up and down as opposed to solely lateral swinging motion which is typical of all hammocks. Uniquely hammock frame 10 both rocks (arrows B, C and D) and swings (arrow A).

The feet 22, 26, 42, 46 form the bounds of base 54 of the hammock frame 10. In this particular embodiment, the pivot axes 30 and 50 form the parallel sides of a trapezoidal shape which base 54 assumes upon assembly and under a load.

Foot link means 56, which suitably may be flexible rope, guys or other flexible material, are fastened between the second bipod feet 42 and 46 which form one of the dimensional widths of the base 54. Optional flexible foot link means 58 may be utilized to secure together the first and second feet 22 and 26 of the first bipod 12. Flexible bipod link means 60 and 62 suitably may also be of rope or other flexible material and are connected between the opposing feet 22 and 42; 26 and 46 of first bipod 12 and second bipod 32. Flexible links 56, 58, 60, 62 may constitute a single length of rope which may initially pass through aperture 24 and be held thereat suitably by a knot 64. Thereafter, the link 60 continues on through aperture 44 whereat a knot 64 may be located and on to aperture 48 where an additional knot 64 may be located and finally pass on through aperture 28 where a last knot 64 may be secured. Again, the link or rope section 58 is optional. Without the rope link 58, the legs 14 and 16 of first bipod 12 will generally settle to be directly over links 60 and 62, respectively.

A typical hammock 66 is made of net, fabric or the like suitably without spreaders. Hammock 66 has a lead rope 68 at each longitudinal end of hammock 66. Lead ropes 68 are passed through apex apertures 20 and 40. Thereafter knots 70 may be formed. By this arrangement, hammock 66 is secure to frame 10.

In operation, the occupant in the hammock 66 supported by frame 10 may shift their weight in a swinging motion as shown by arrow A or may move in a rocking motion as shown by arrow B. As the hammock 66 is rocked (arrow B), first bipod and second bipod 12, 32 pivot about their respective axes 30, 50 (arrows C and D) as the point of bipod intersection 52 moves longitudinally (arrow B), thereby moving the proximate center of gravity of the occupant just above intersection point 52 and also above base 54.

Bipods 12, 32, particularly their respective legs 14, 16, 34, 36, suitably may be made of sturdy wood or of other strong materials such as tubing. The legs may be segmented. If the legs are segmented they may be assembled in sections by way of male and female couplings or any suitable arrangement. Also, the legs 14, 16, 34, 36 may be of a telescopic design which will also make the hammock frame 10 readily collapsible down to a small unit for easy storage and transportation. Male-female couplings may have the legs 14, 16, 34, 36 formed like fish pole segments which readily will slide within each other to form the hammock frame 10 while yet permitting easy disassembly for storage and transportation of the collapsed frame 10.

In setting up hammock 10 for use, the present embodiment frame 10 has its legs 14, 16, 34, 36 laid out and fastened together by tying the link means or rope segments 56, 60, 62 into knots 64 at foot apertures 24, 28, 44, 48. By this arrangement, the base 54 is defined. The fastening of the hammock 66, particularly its lead rope 68, is the last step. Once the lead ropes 68 are secured to apexes 18 and 38, both bipods 12 and 32 are raised and the hammock 66 is thus suspended ready for an occupant.

There is a broad range of sets of relative dimensions that allows the biaxial rocking swinging hammock frame 10 to function. Within this range the invention can offer different performances and safety characteristics beyond the simple ability to remain erect. For purposes of illustration only and not patent limitation, the inventor weighing about 175 pounds suggests the following dimensional sets have been shown to be successfully operative with respect to this embodiment:

| COMPONENT IDENTIFY | LENGTH |
|---|---|
| Hammock 66 stretched between bipods 12, 32 | 16' 4" |
| Legs 14, 16, 34, 36 | 12' 4" |
| Rope 62 | 5' 2" |
| Rope 60 | 5' 2" |
| Rope 56 | 3' 7" |
| Optional rope 58 | 5' 7" |

Again, these dimensions are for purposes of illustration alone in that the length of the elements, particularly the ropes, may be adjusted as to fine tune the hammock frame 10.

In operation, the bipods 12, 32 of the hammock frame 10 have the ability to move around their respective axes 30 and 50 to adjust and share the load equally between all legs 14, 16, 34, 36 which contributes greatly to the overall strength of the hammock frame 10 by never placing too great a strain on any single leg. If the rocking movement is not desired, the bipods 12 and 32 can be easily immobilized by setting up the frame so that the outer bipod legs 14 and 16 contact the inner bipod legs 34 and 36 and securing the legs together at their point of contact and intersection 52. The result is a hammock frame 10 that does not rock. Alternatively, the bipod apexes 18 and 38 can be secured by way of rope to their opposing bipod's feet as to limit the arcs of the swinging or rocking bipods 12 and 32.

Referring to FIGS. 8–11, a second embodiment of the biaxial rocking swinging hammock frame 80 may be seen. The first bipod 82 similarly forms an imaginary isosceles triangular plane wherein the first leg 84 is one of the two long legs of the isosceles triangle having an apex 86 at its upper first leg 84 end. At the apex 86 is the fastening point or hook 88 for the loops 128 of the lead ropes 126 of hammock 124. The lower first leg 84 has a joint 90 from which the second leg 92 horizontally extends inwardly and comprises the short leg of the isosceles triangle. The second leg 92 is also commonly known as the foot 93 terminating into a foot end 94. Foot 93 defines one-half of base 96 and is also whereat the first bipod pivot axis 98 is located upon which the first bipod 82 pivots up and down.

The second bipod 102 similarly forms an imaginary isosceles triangular plane. The first leg 104 of the second bipod 102 is one of the long legs of the isosceles triangle. The upper first leg 104 end comprises the apex 106 whereat the fastening point or hook 108 is located. The lower second leg end has its joint 110 thereat from which the second leg 112 horizontally extends inwardly forming the short leg of the imaginary isosceles triangle. Second leg 112 also is referred as the foot 113 terminating in foot end 114 and defines the second half of the base 96. Foot 113 is also where the second bipod pivots axis 116 is located which is substantially parallel to the first bipod pivot axis 98. Flexible foot links or ropes 118 suitably tie the feet 93 and 113 of their respective bipods 101 and 102 together. The operation of the second embodiment hammock frame 80 is similar to the first hammock frame 10. While the bipods 82 and 102 may be a singular tubular construction, they undoubtedly should be of a strong material. Bipods 82 and 102 also may be segmented for easy disassembly, storage and transportation.

Figure 12:
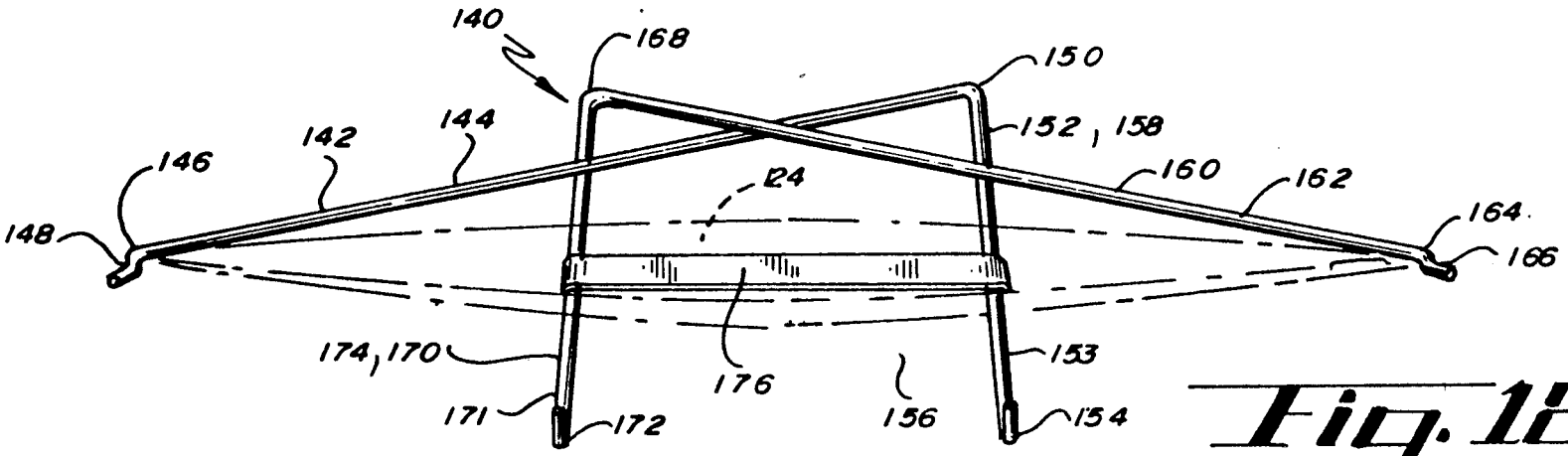
FIG. 12 is a perspective view of yet another embodiment of the present hammock frame.

Referring to FIG. 12, a third embodiment of the biaxial rocking swinging hammock frame 140 is shown. The hammock frame 140 includes first bipod 142, first leg 144 and apex 146 whereat fasteninq point means or hook 148 is located. Joint 150 of the bipod 142 is from where the second leg 152 or foot 153 extends forming one-half of base 156 and the location for first bipod pivot axis 158. Foot 153 terminates in foot end 154. Second bipod 160 also includes first leg 162 having an apex 164 whereat fastening point 166 is located. At joint 168 a second leg 170 or foot 171 extends whereat the second bipod pivot axis 174 is located and ending at foot end 172. Hammock frame 140 is similar to hammock frame 80. However, the first legs 144 and 162 are located on the same side in hammock frame 140 as opposed to the legs 84 and 104 being on opposite sides in hammock frame 80.

A torsion bar 176 suitably may be connected between the feet 153 and 171 of hammock frame 140, as shown in FIG. 12. Bar 176 will also operate With hammock frame 80. Torsion frame 176 simply limits the range of rocking motion for the hammock frame 80 or 140 as to add further stability to the appearance as well as the operation of hammock frame 80 or 140.

The present invention may be embodied in other specific forms without departing from the spirit or essential attributes thereof; therefore, the illustrated embodiment should be considered in all respects as illustrative and not restrictive, reference being made to the appended claims rather than to the foregoing description to indicate the scope of the invention.

What is claimed:

1. A biaxial rocking swinging hammock frame for a hammock with two connecting ends, comprising:

(a) a first bipod having first and second legs joined at their upper ends to form a first apex adapted for securing one connecting end of the hammock thereto, the first and second legs of the first bipod each have a lower end which are connected together by a flexible link means which permits independent movement of said lower ends, the lower ends forming a foot upon which the first bipod pivots along a first bipod pivot axis;

(b) a second bipod having first and second legs joined at their upper ends to form a second apex adapted for securing the other connecting end of the hammock thereto, the first and second legs of the second bipod each having a lower end which are connected together by a flexible link means which permits independent movement of said lower ends, the lower ends forming a foot upon which the second bipod pivots along a second bipod pivot axis as to permit rocking and swinging of the hammock; and (c) link means connecting the feet to form a trapezoidal base for the frame by locating and holding the feet and pivot axis of the first bipod below the second bipod and the feet and pivot axis of the second bipod below the first bipod.

2. The biaxial rocking swinging hammock frame of claim 1 wherein the first and second bipod forms two intersecting isosceles triangular planes.

3. The biaxial rocking swinging hammock frame of claim 1 wherein an axis of intersection of the planes is above the base and proximate the center of gravity for the frame.

4. The biaxial rocking swinging hammock frame of claim 1 wherein the link means are flexible.

5. A biaxial rocking swinging hammock frame for a hammock with two connecting ends, comprising:

(a) first and second bipods each consisting first and second legs with an upper first leg end defining an apex adapted for securing one of the two connecting ends of the hammock thereto and a lower first leg end defining a joint from which the second leg horizontally extends forming a base, foot and a pivot axis upon which the respective bipods pivot as to permit rocking and swinging of the hammock; and (b) link means connecting the base foot of each bipod for locating and holding the foot and pivot axis of the first bipod below the second bipod and the foot and pivot axis of the second bipod below the first bipod.

6. The biaxial rocking swinging hammock frame of claim 5 wherein the first and second bipods form two intersecting isosceles triangular planes.

7. The biaxial rocking swinging hammock frame of claim 5 wherein an axis of intersection of the planes is above the base and proximate the center of gravity for the frame.

8. The biaxial rocking swinging hammock frame of claim 5 wherein the link means are flexible.

* * * * *

UNITED STATES PATENT AND TRADEMARK OFFICE

CERTIFICATE OF CORRECTION

PATENT NO. : 5,097,546

DATED : March 24, 1992

INVENTOR(S) : George C. Turner, III

It is certified that error appears in the above-identified patent and that said Letters Patent is hereby corrected as shown below:

Column 3, line 58, after "D" and before "and", insert --)--.

Column 6, line 64, delete "1" and replace it with --2--.

Column 8, line 8, delete "5" and replace it with --6--.

Signed and Sealed this

Twelfth Day of October, 1993

Bruce Lehman

*Attest:*

BRUCE LEHMAN

*Attesting Officer*

*Commissioner of Patents and Trademarks*